US006124835A

United States Patent [19]

Nguyen et al.

[11] Patent Number: 6,124,835

[45] Date of Patent: Sep. 26, 2000

[54] DEPLOYMENT OF DUAL REFLECTOR SYSTEMS

[75] Inventors: Stephen D. Nguyen, Garden Grove; Leonard A. Hoey, Rolling Hills; Joseph G. Scarangello, Redondo Beach; Dean R. Huebert, Simi Valley; Mark R. Wilken, El Segundo, all of Calif.

[73] Assignee: TRW Inc., Redondo Beach, Calif.

[21] Appl. No.: 09/346,193

[22] Filed: Jul. 1, 1999

[51] Int. Cl.[7] ..... H01Q 1/08

[52] U.S. Cl. ..... 343/881; 343/840; 343/880; 343/DIG. 2

[58] Field of Search ..... 343/878, 879, 343/880, 881, 882, 915, 840, 781 R, 781 CA, DIG. 2; H01Q 1/08

[56] References Cited

U.S. PATENT DOCUMENTS

| | | | |
|---|---|---|---|
| 4,562,441 | 12/1985 | Beretta et al. | 343/DIG. 2 |
| 4,771,293 | 9/1988 | Williams et al. | 343/881 |
| 5,485,168 | 1/1996 | Parekh | 343/781 P |
| 5,644,322 | 7/1997 | Hayes et al. | 343/915 |

*Primary Examiner*—Hoanganh Le
*Assistant Examiner*—Hoang Nguyen
*Attorney, Agent, or Firm*—Michael S. Yatsko

[57] ABSTRACT

A method and system for deploying a multi-reflector antenna system (10). The antenna system (10) includes an antenna structure (12) mounted to a satellite (14), where an antenna feed array (16) is mounted to the antenna structure (12). A single articulated antenna arm assembly (26) is mounted to the antenna structure (12) by a first spring loaded hinge (28). The arm assembly (26) includes a first arm (30) on which is mounted a first reflector (38), and a second arm (32) on which is mounted a second reflector (40). The first and second arms (30, 32) are connected to each other by a second spring loaded hinge (34) such that the reflectors (38, 40) directly oppose each other and are substantially parallel when the arm assembly (26) is in the stowed position. A plurality of launch locks (44, 46, 50, 54) hold the arm assembly (26) in the stowed position against the bias of the hinges (28, 34) prior to deployment. When the antenna system (10) is ready to be deployed, the launch locks (44, 46, 50, 54) are released in a predetermined sequence such that the arm assembly (26) first moves away from the feed array (16) under the bias of the first hinge (28), and then the second arm (32) moves away from the first arm (30) under the bias of the second hinge (34). When the antenna system (10) is in the fully deployed state, the feed array (16) and the first and second reflectors (38, 40) are oriented relative to each other to define a side-fed geometry.

17 Claims, 1 Drawing Sheet

DEPLOYMENT OF DUAL REFLECTOR SYSTEMS

BACKGROUND OF THE INVENTION

1. Field of the Invention

This invention relates generally to a system and method for the deployment of dual reflectors and, more particularly, to a system and method for the deployment of a side-fed dual reflector system used in connection with a Ka band satellite.

2. Discussion of the Related Art

Various communication systems, such as certain telephone systems, television broadcast systems, internet systems, military communication systems, etc., make use of satellites orbiting the Earth in a geosynchronous orbit, where the satellites are maintained at the same location relative to the Earth or non-geosynchronous orbit, where the satellites do not maintain the same relative position. A satellite uplink communications signal is transmitted to the satellite from one or more ground stations, and then re-transmitted by the satellite to the Earth as a downlink communications signal to cover a desirable reception area depending on the particular use. The uplink and downlink signals are transmitted at a particular frequency bandwidth, such as the Ka frequency bandwidth, and are frequently coded. The satellite is equipped with antenna system(s) including a plurality of antenna feeds that receive the uplink signals and direct the downlink signals to the Earth. The configuration of the antenna feeds and associated antenna optics of the antenna system is designed to provide coverage over a specifically defined area on the Earth, such as the continental United States, although coverage could also be global.

Certain antenna system designs make use of multiple reflectors to direct the downlink signals from the antenna feeds to the Earth, or the uplink signals from the Earth to the antenna feeds. For example, a downlink antenna feed array including a plurality of antenna feeds may be positioned relative to a sub-reflector and main reflector, where the sub-reflector receives the beams from the feeds and directs the beams towards the main reflector to be directed towards the Earth. The orientation of the feed array, sub-reflector and main reflector can take various geometries and configurations depending on a particular design. These designs require that the sub-reflector and main reflector be positioned at select locations and orientations relative to the feed array depending on the focal lengths of the design.

Serious considerations are given to the design of an antenna system of the type discussed herein apart from the actual geometry of the antenna system for providing the desired Earth coverage area. Particularly, the feed array and reflectors need to be mounted on a supporting structure in a manner that minimizes use of the available real estate on the satellite. Further, the antenna system must be compact and lightweight, but be strong enough to survive the satellite launch and space environment, as well as fit within the launch vehicle fairing. Typically, these designs require that the reflectors be at least partially stowed in a folded position during launch, and later deployed once the satellite is in orbit. Known deployment strategies would either deploy each reflector of a dual reflector antenna system on a separate boom or arm, or deploy one of the reflectors on a movable arm and maintain the other reflector fixed to a bus or antenna structure. These designs typically take up significant space to satisfy the launch and deployment requirements. Modern dual reflector antenna systems sometimes have relatively long focal lengths and may require that both reflectors be stowed in a folded position.

What is needed is an improved deployment strategy for deploying multiple reflectors associated with a multiple reflector antenna system. It is therefore an object of the present invention to provide such a strategy.

SUMMARY OF THE INVENTION

In accordance with the teachings of the present invention, a method and system for deploying a multiple reflector antenna system is disclosed. The antenna system includes an antenna structure mounted to a satellite, where an antenna feed array is mounted to the antenna structure. A single articulated antenna arm assembly is mounted to the antenna structure by a first deployment device, such as spring loaded hinge. The arm assembly includes a first arm on which is mounted a first reflector, and a second arm on which is mounted a second reflector. The first and second arms are connected to each other by a second deployment device, such as a spring loaded hinge, such that the reflectors oppose each other when the arm assembly is in the stowed position. A plurality of launch locks hold the arm assembly in the stowed position against the bias of the hinges prior to deployment.

When the satellite is in space and the antenna system is ready to be deployed, the launch locks are released in a predetermined sequence such that the arm assembly first moves away from the feed array under the bias of the first hinge, and then the second arm moves away from the first arm under the bias of the second hinge. In one embodiment, when the antenna system is in the fully deployed state, the feed array and the first and second reflectors are oriented relative to each other in a side-fed geometry.

Additional objects, advantages, and features of the present invention will become apparent from the following description and appended claims, taken in conjunction with the accompanying drawings.

DETAILED DESCRIPTION OF THE PREFERRED EMBODIMENTS

Figures 1, 2, 3:
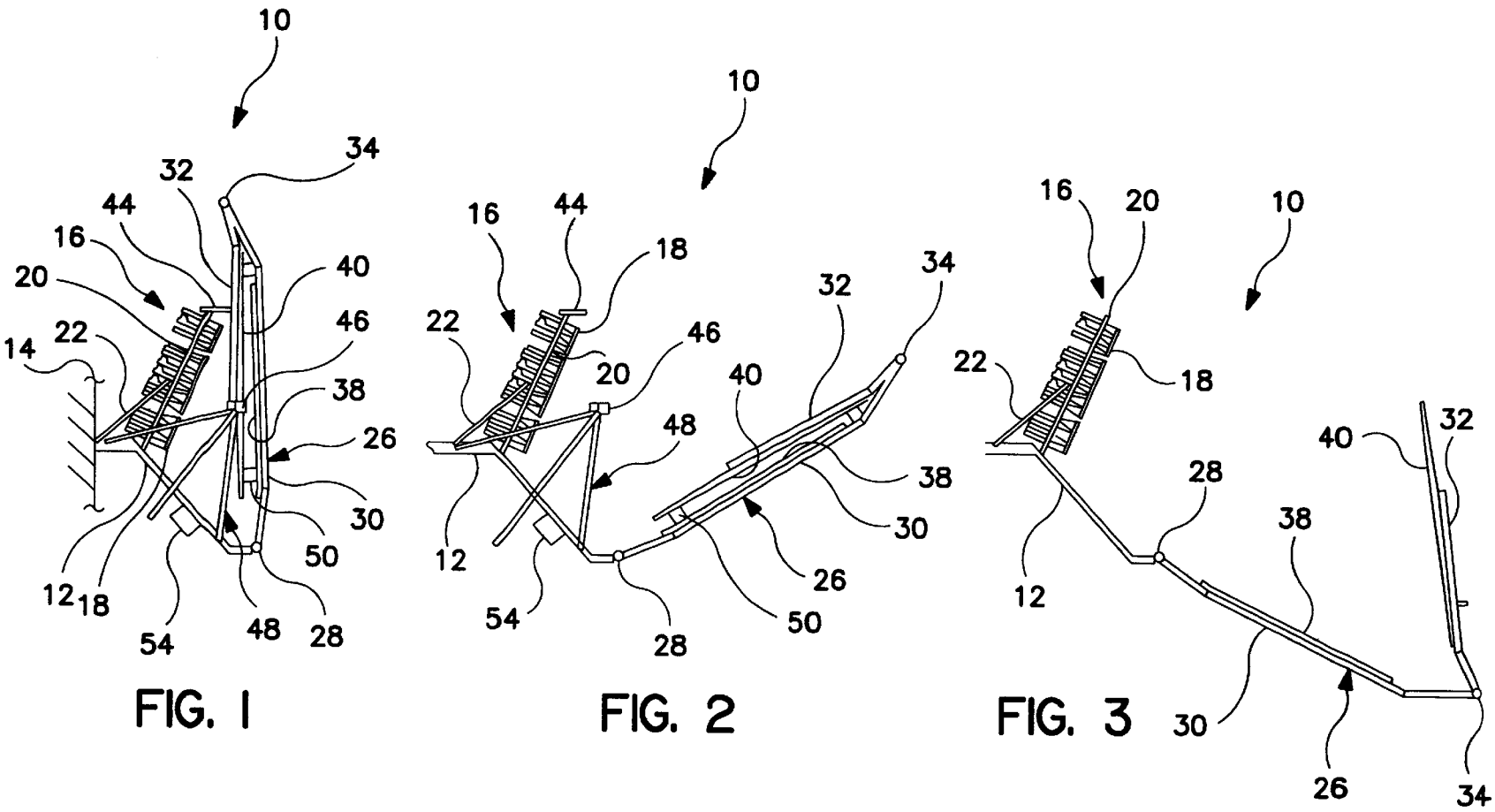
FIG. 1 is a side plan view of a fully stowed antenna system that includes multiple reflectors, according to the present invention.
FIG. 2 is a side plan view of the antenna system depicted in FIG. 1 that is partially deployed.
FIG. 3 is a side plan view of the antenna system depicted in FIGS. 1 and 2 that is fully deployed in a side-fed geometry.

The following description of the preferred embodiments directed to a strategy and apparatus for deploying a multi-reflector antenna system from a satellite is merely exemplary in nature, and is in no way intended to limit the invention or its applications or uses. Particularly, the discussion below concerns deploying a side-fed multi-reflector antenna system used in connection with a satellite. However, the deployment strategy of the present invention has other uses for deploying multiple reflectors other than side-fed reflectors for satellites.

FIG. 1 shows a side plan view of a multi-reflector antenna system 10 including an integrated antenna mounting structure 12 secured to a satellite platform or bus 14 (partially shown herein) at a strategic location, such as the nadir facing portion of the satellite, depending on the particular design requirements of the antenna and satellite system. In a practical application, the antenna system 10 is one of a plurality of similar antenna systems mounted to the bus 14. A feed array 16 including a plurality of antenna feed horns 18 is secured to a mounting plate 20 so that the horns 18 are arranged along a predetermined contour consistent with the antenna design. The mounting plate 20 is mounted to the antenna structure 12 so that the feed array 16 is positioned at a particular location and orientation that is also consistent with the antenna design. A notional supporting bracket 22 is connected to the plate 20 and the structure 12 as shown.

A single articulated antenna arm assembly 26 is connected to the antenna structure 12 by a first spring-biased deployment hinge 28. The deployment hinge 28 is in a spring loaded condition when the assembly 26 is in the stowed position. The bias of the deployment hinge 28 provides a force such that when the antenna system 10 is deployed, the arm assembly 26 will move away from the satellite at a predetermined rate and force. The antenna arm assembly 26 includes a first antenna arm 30 and a second antenna arm 32 connected together by a second spring-biased deployment hinge 34. The deployment hinges 28 and 34 can be any deployment hinge or mechanism available in the art suitable for the purposes of the present invention as described herein. The arms 30 and 32 can be made of any suitable material or alloy, such as a graphite composite, that will satisfy the environmental requirements. A main reflector 38 is mounted to the arm 30 and a sub-reflector 40 is mounted to the arm 32 so that the reflectors 38 and 40 directly oppose each other and are substantially parallel in the stowed state. The reflectors 38 and 40 can be made of any suitable reflector material known in the art, such as a graphite composite, and be mounted to the respective arm 30 or 32 in any suitable manner consistent with the discussion herein, such as by a lightweight mechanical connection.

The antenna system 10 includes a plurality of launch locks that maintain the antenna arm assembly 26 in the stowed position against the bias of the hinges 28 and 34 prior to being deployed. In one design, the antenna system 10 incorporates five launch locks for suitable stowage. In one example, each launch lock includes an electrical device that receives an electrical signal that disengages a mechanical connection. Of course, any launch lock suitable for the purposes described herein can be used. In the embodiment shown herein, a reflector forward launch lock 44 is connected to the antenna feed mounting plate 20 and the arm 32 as shown. Additionally, two aft reflector launch locks 46 (nearside and farside) are mounted to the reflectors (38, 40). Launch locks 46 connect the reflectors to launch lock support structure 48, for example, consisting of three support struts that are connected to the antenna structure 12, as shown. Further, a reflector internal launch lock 50 connects the main reflector 38 and subreflector 40. A structure launch lock 54 is provided to connect the antenna structure 12 to the satellite bus 14.

In the stowed position, all of the launch locks 44, 46, 50, and 54 are restrained (locked), and the hinges 28 and 34 are under spring tension. When the antenna system 10 is to be deployed, the launch locks 44 and 46 are first released from the arm 32, and reflectors 38, 40 so that the spring bias of the hinge 28 causes the arm assembly 26 to move away from the feed array 16, as shown in the partially deployed state in FIG. 2. As is apparent, the launch lock 50 has not yet been released because when the assembly 26 is proximate to the feed array 16 in the stowed position, the arm 32 would contact the feed array 16 if it were released. Once the arm assembly 26 has moved far enough away from the feed array 16, the launch lock 50 is released so that the arm 32 is deployed by the bias of the hinge 34. This launch lock (50) function can also be achieved through deployment rate control of the hinges. Additionally, the structure launch lock 54 is also released.

FIG. 3 shows the antenna system 10 when all of the launch locks 44, 46, 50, and 54 have been released and the arm assembly 26 fully deployed. The launch locks 44, 46, 50, and 54 and the launch lock support structure 48 are not shown in this figure for clarity purposes. In this configuration, the orientation of the feed array 16, the sub-reflector 40, and the main reflector 38 are in a side-fed geometry. In the case of a downlink antenna, where the sub-reflector 40 receives the beams from the feed horns 18, and directs the beams toward the main reflector 38 in a manner which satisfies the focal length of the reflector 38. The main reflector 38 directs the beams towards the Earth over the desired coverage area. In this side-fed design, the sub-reflector 40 has a hyperbolic contour and the main reflector 38 has a parabolic contour. A more detailed discussion of a side-fed antenna system can be found in U.S. patent application Ser. No. 09/232,452, titled Side-Fed Dual Reflector System for Cellular Coverage, filed Jan. 15, 1999. Of course, other antenna configurations and designs can be provided within the scope of the present invention.

The foregoing discussion discloses and describes merely exemplary embodiments of the present invention. One skilled in the art will readily recognize from such discussion, and from the accompanying drawings and claims, that various, changes, modifications and variations can be made therein without departing from the spirit and scope of the invention as defined in the following claims.

What is claimed is:

1. A dual reflector system comprising:

a support structure;

an articulating arm assembly mounted to the support structure by a first actuating mechanism, said arm assembly including a first arm and a second arm being connected together by a second actuating mechanism; and a first reflector mounted to the first arm and a second reflector mounted to the second arm such that the first and second reflectors directly oppose each other when the arm assembly is in a stowed state, wherein the first arm articulates on the first actuating mechanism and the second arm articulates on the second mechanism to deploy the arm assembly and the reflector system to a deployed state.

2. The system according to claim 1 wherein the first and second actuating mechanisms are spring loaded hinges.

3. The system according to claim 1 wherein the dual reflector system is part of an antenna system including an antenna feed array mounted to the support structure, said first and second reflectors moving away from the antenna feed array when the arm assembly is moved from the stowed state to the deployed state.

4. The system according to claim 3 wherein the antenna feed array and the first and second reflectors are positioned in a side-fed orientation when the system is in the deployed state.

5. The system according to claim 4 wherein the second reflector is a sub-reflector and has a hyperbolic contour, and the first reflector is a main reflector and has a parabolic contour.

6. The system according to claim 1 wherein the arm assembly is held in the stowed state by a plurality of locking mechanisms.

7. The system according to claim 1 wherein the support structure is mounted to a satellite.

8. A dual reflector antenna system for use in connection with a communications satellite, said antenna system comprising:

a support structure mounted to the satellite;

an antenna feed array including a plurality of antenna feeds positioned on an feed mounting plate, said mounting plate being mounted to the support structure;

an articulating arm assembly mounted to the support structure by a first actuating mechanism, said arm assembly including a first arm and a second arm being connected together by a second actuating mechanism;

a first reflector mounted to the first arm and a second reflector mounted to the second arm such that the first and second reflectors directly oppose each other when the arm assembly is in a stowed state; and a plurality of launch lock mechanisms connected to the arm and reflector assembly, said plurality of lock mechanisms maintaining the arm assembly in the stowed state, said launch lock mechanisms being released to deploy the antenna system, where the first arm articulates on the first actuating mechanism and the second arm articulates on the second actuating mechanism to a deployed state that defines a predetermined antenna position and orientation between the antenna feed array and the first and second reflectors.

9. The system according to claim 8 wherein the first and second actuating mechanisms are spring loaded hinges that are held under a spring bias when the arm assembly in the stowed state, said hinges causing the first and second arms to move when the launch lock mechanisms are released.

10. The system according to claim 8 wherein the plurality of launch lock mechanisms includes a first set of launch lock(s) connecting the reflectors and a launch lock support structure, which is in turn connected to the antenna support structure, a second launch lock connecting the second arm and the antenna feed mounting plate, and a third launch lock connecting the first and second reflectors.

11. The system according to claim 8 wherein the antenna feed array and the first and second reflectors are positioned in a side-fed orientation when the system is in the deployed state.

12. The system according to claim 11 wherein the first reflector is a main reflector and has a parabolic contour and the second reflector is a sub-reflector and has a hyperbolic contour.

13. A method of deploying a dual reflector system, comprising:

providing a support structure;

providing an articulated arm and reflector assembly mounted to the support structure by a first actuating mechanism;

connecting a first arm and a second arm of the articulated arm assembly by a second actuating mechanism;

positioning the reflector system in a stowed position by actuating the first and second actuating mechanisms so that the first and second reflectors directly oppose each other and the arm assembly is positioned proximate the support structure;

providing a plurality of locking mechanisms connected to the arm and reflector assembly to hold the articulated arm assembly in the stowed position; and deploying the reflector system from the stowed position to a deployed position by releasing the locking mechanisms so that the arm assembly articulates on the first actuating mechanism to move away from the support structure and the second arm articulates on the second actuating mechanism to move away from the first arm.

14. The method according to claim 13 wherein the first and second arms are connected to each other by a first spring loaded hinge and the arm assembly is mounted to the support structure by a second spring loaded hinge.

15. The method according to claim 13 further comprising mounting the support structure to a satellite.

16. The method according to claim 15 further comprising mounting an antenna feed array to the support structure.

17. The method according to claim 16 wherein the antenna feed array and the first and second reflectors are positioned in a side-fed orientation when the system is in the deployed position.

* * * * *